US006906665B1

(12) United States Patent
Lam

(10) Patent No.: US 6,906,665 B1
(45) Date of Patent: Jun. 14, 2005

(54) CLUSTER BEAM-FORMING SYSTEM AND METHOD

(75) Inventor: Lawrence K. Lam, San Jose, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/704,197

(22) Filed: Nov. 6, 2003

Related U.S. Application Data

(60) Provisional application No. 60/426,485, filed on Nov. 15, 2002.

(51) Int. Cl.[7] ..... H01Q 3/22

(52) U.S. Cl. ..... 342/368; 342/372; 342/373

(58) Field of Search ..... 342/81, 154, 368, 342/372, 373

(56) References Cited

U.S. PATENT DOCUMENTS 4,962,383 A * 10/1990 Tresselt ..... 343/700 MS
5,162,803 A * 11/1992 Chen ..... 342/372
5,936,588 A * 8/1999 Rao et al. ..... 343/754
5,977,910 A 11/1999 Matthews
6,078,287 A 6/2000 Thompson et al.
6,104,343 A * 8/2000 Brookner et al. ..... 342/372
6,169,513 B1 1/2001 Cohen

OTHER PUBLICATIONS

Mailloux, "*Phased Arrays in Radar and Communication Systems*", Phased Array Antenna Handbook, 1994, Artec House, Norwood, MA, pp. 1–192.

* cited by examiner

*Primary Examiner*—Dao Phan
(74) *Attorney, Agent, or Firm*—McDermott Will & Emery LLP

(57) ABSTRACT

A method and system for detecting a plurality of objects. The method includes steering a first beam-forming system to a first direction. The first direction is associated with a first object. Additionally, the method includes steering a second beam-forming system to a second direction. The second direction is associated with a second object. Moreover, the method includes receiving a first plurality of signals, and receiving a second plurality of signals. Also, the method includes generating a first combined signal, generating a second combined signal, dividing the first combined signal, and dividing the second combined signal. Additionally, the method includes generating a first output signal and generating a second output signal. The first output signal is associated with the first object, and the second output signal is associated with the second object.

24 Claims, 10 Drawing Sheets

CLUSTER BEAM-FORMING SYSTEM AND METHOD

CROSS-REFERENCES TO RELATED APPLICATIONS

This application claims priority to U.S. Provisional No. 60/426,485 filed Nov. 15, 2002, which is incorporated by reference herein.

BACKGROUND OF THE INVENTION

The present invention relates in general to detecting objects and/or areas. More particularly, the invention provides a method and system for cluster beam-forming. Merely by way of example, the invention is described as it applies to a phased array antenna, but it should be recognized that the invention has a broader range of applicability.

A phased array antenna has been widely used for communications and radar systems. The phased array antenna usually does not mechanically steer antenna directions, and can provide rapid beam scanning. The phased array antenna can also direct transmission power to an intended target and thereby reduce power loss. The directivity of the phase array antenna can be achieved by properly adjusting the relative phases between signals transmitted or received by different antenna elements. These antenna elements can reinforce the transmitted or received radiation in a desired direction.

The phased array antenna usually has a number of subarrays, and each subarray includes multiple antenna elements. For example, a phased array antenna has one hundred and twenty-eight subarrays, and each subarray includes eight antenna elements. Consequently, the phased array antenna has one thousand and twenty-four antenna elements. These antenna elements occupy an area called a phased array antenna panel. The beam pattern of a panel depends on two other beam patterns, namely, the subarray beam pattern and the panel beam pattern. The subarray beam pattern relates to an individual subarray, and the panel beam pattern relates to an array of subarrays.

FIG. 1 is a simplified diagram for subarrays of antenna elements and an array of subarrays for a conventional phased array antenna. A phased array antenna 100 includes subarray beam forming systems 110, 112, and 114, and a panel beam forming system 120. Each subarray beam forming system 110, 112, or 114 includes a subarray of antenna elements and forms a subarray beam pattern. The panel beam forming system 120 forms a panel beam pattern. The subarray beam patterns and the panel beam pattern determine the beam pattern of the phased array antenna 100. Each subarray beam forming system includes various electronic components and can electronically steer the reception or transmission direction of the subarray.

The phased array antenna system usually has the same number of beam-formers within a subarray as the number of beam-formers within a panel antenna, which is also the number of beams provided by the phased array antenna. Each beam of the phased array antenna system is provided by a designated panel antenna beam-former, which is fed by a set of designated subarray beam-formers. The designated subarray beam forming and panel beam forming systems arc usually set to the same reception or transmission direction to produce a single beam. This approach of having a complete set of designated subarray and panel beam formers point to the same direction to provide a single beam usually requires multiple sets of such antenna beam forming systems to produce multiple electronically scanned beams.

Hence it is highly desirable to improve beam-forming techniques.

BRIEF SUMMARY OF THE INVENTION

The present invention relates in general to detecting objects and/or areas. More particularly, the invention provides a method and system for cluster beam-forming. Merely by way of example, the invention is described as it applies to a phased array antenna, but it should be recognized that the invention has a broader range of applicability.

According to a specific embodiment of the present invention, a method for detecting a plurality of objects includes steering a first beam-forming system to a first direction. The first direction is associated with a first object. Additionally, the method includes steering a second beam-forming system to a second direction. The second direction is associated with a second object. Moreover, the method includes receiving a first plurality of signals from at least the first object and the second object at the first beam-forming system, receiving a second plurality of signals from at least the first object and the second object at the second beam-forming system, processing the first plurality of received signals, and processing the second plurality of received signals. Also, the method includes generating a first combined signal based on at least information associated with the first plurality of received signals, and generating a second combined signal based on at least information associated with the second plurality of received signals. Additionally, the method includes dividing the first combined signal into at least a first divided signal and a second divided signal, and dividing the second combined signal into at least a third divided signal and a fourth divided signal. Moreover, the method includes processing at least the first divided signal, the second divided signal, the third divided signal, and the fourth divided signal. Also, the method includes generating a first output signal based on at least information associated the first divided signal and the third divided signal, and generating a second output signal based on at least information associated with the second divided signal and the fourth divided signal. The first output signal is associated with the first object, and the second output signal is associated with the second object.

According to another embodiment of the present invention, a method for detecting a plurality of objects includes steering a first beam-forming system to a first direction. The first direction is associated with a first object. Additionally, the method includes steering a second beam-forming system to a second direction. The second direction is associated with a second object. Moreover, the method includes receiving a first plurality of signals from at least the first object and the second object at the first beam-forming system, and receiving a second plurality of signals from at least the first object and the second object at the second beam-forming system. Also, the method includes generating a first combined signal based on at least information associated with the first plurality of received signals, and generating a second combined signal based on at least information associated with the second plurality of received signals. Additionally, the method includes dividing the first combined signal into at least a first divided signal and a second divided signal, and dividing the second combined signal into at least a third divided signal and a fourth divided signal. Moreover, the method includes generating a first output signal based on at least information associated with the first divided signal and the third divided signal, and generating a second output signal based on at least information associated with the second divided signal and the fourth divided signal. The steering a first beam-forming system to a first direction is substantially free from changing a first phase center of the first beam-forming system. The steering a second beam-forming system to a second direction is substantially free from changing a second phase center of the second beam-forming system. The first output signal is associated with the first object, and the second output signal is associated with the second object.

According to yet another embodiment of the present invention, a system for detecting a plurality of objects includes a first beam-forming system configured to steer to a first direction, receive a first plurality of signals from at least the first object and a second object, and generate a first combined signal based on at least information associated with the first plurality of received signals. The first direction is associated with a first object. Additionally, the system includes a second beam-forming system configured to steer to a second direction, receive a second plurality of signals from at least the first object and the second object, and generate a second combined signal based on at least information associated with the second plurality of received signals. The second direction is associated with the second object. Moreover, the system includes a first divider system configured to divide the first combined signal into at least a first divided signal and a second divided signal, and a second divider system configured to divide the second combined signal into at least a third divided signal and a fourth divided signal. Also, the system includes a first phase shifter, a second phase shifter, a third phase shifter and a fourth phase shifter configured to process at least the first divided signal, the second divided signal, the third divided signal, and the fourth divided signal respectively. Additionally, the system includes a first combiner system configured to generate a first output signal based on at least information associated the first divided signal and the third divided signal, and a second combiner system configured to generate a second output signal based on at least information associated with the second divided signal and the fourth divided signal. The first output signal is associated with the first object, and the second output signal is associated with the second object.

According to yet another embodiment of the present invention, a system for detecting a plurality of objects comprises a first beam-forming system configured to steer to a first direction, receive a first plurality of signals from at least the first object and a second object, generate a first combined signal based on at least information associated with the first plurality of received signals. The first direction is associated with a first object. Additionally, the system includes a second beam-forming system configured to steer to a second direction, receive a second plurality of signals from at least the first object and the second object, and generate a second combined signal based on at least information associated with the second plurality of received signals. The second direction is associated with the second object. Moreover, the system includes a first divider system configured to divide the first combined signal into at least a first divided signal and a second divided signal, and a second divider system configured to divide the second combined signal into at least a third divided signal and a fourth divided signal. Also, the system includes a first combiner system configured to generate a first output signal based on at least information associated the first divided signal and the third divided signal, and a second combiner system configured to generate a second output signal based on at least information associated with the second divided signal and the fourth divided signal. The first beam-forming system is configured to steer electronically without substantially changing a first phase center of the first beam-forming system. The second beam-forming system is configured to steer electronically without substantially changing a second phase center of the second beam-forming system. The first output signal is associated with the first object, and the second output signal is associated with the second object.

According to yet another embodiment of the present invention, a method for detecting a change of a phase center includes steering a first antenna to a first direction associated with a first phase center corresponding to the first direction, sending a first signal from a signal source to the first antenna, and receiving the first signal at the first antenna associated with the first direction. Additionally, the method includes steering the first antenna to a second direction associated with a second phase center corresponding to the second direction, sending a second signal from the signal source to the first antenna, and receiving the second signal at the first antenna associated with the second direction. Moreover, the method includes determining a first phase based on at least information associated with the first sent and received signal, determining a second phase based on at least information associated with the second sent and received signal, processing at least information associated with the first phase and the second phase, and determining whether the first phase center is the same as the second phase center based on at least information associated with the first phase and the second phase.

According to yet another embodiment of the present invention, a system for detecting a change of a phase center includes a first antenna configured to steer to a first direction and a second direction and receive a first signal and a second signal. The first direction is associated with a first phase center of the first antenna, and the second direction is associated with a second phase center of the first antenna. Additionally, the system includes a signal source configured to send the first signal to the first antenna associated with the first direction and send the second signal to the first antenna associated with the second direction. Moreover, the system includes a processing system configured to determine a first phase based on at least information associated with the first sent and received signal, determine a second phase based on at least information associated with the second sent and received signal, process at least information associated with the first phase and the second phase, and determine whether the first phase center is the same as the second phase center based on at least information associated with the first phase and the second phase.

According to yet another embodiment of the present invention, a method for detecting a plurality of objects includes receiving a first input signal, receiving a second input signal, generating a first divided signal and a second divided signal based on at least information associated with the first input signal, and generating a third divided signal and a fourth divided signal based on at least information associated with the second input signal. Additionally, the method includes processing at least the first divided signal, the second divided signal, the third divided signal, and the fourth divided signal. Moreover, the method includes combining at least the first divided signal and the third divided signal into a first combined signal, combining at least the second divided signal and the fourth divided signal into a second combined signal, generating a first plurality of signals based on at least information associated with the first combined signal, and generating a second plurality of signals based on at least information associated with the second combined signal. Also the method includes steering a first beam-forming system to a first direction. The first direction associated with a first object. Additionally, the method includes steering a second beam-forming system to a second direction. The second direction associated with a second object. Moreover, the method includes processing the first plurality of signals, processing the second plurality of signals, transmitting the first plurality of signals to at least the first object and the second object at the first beam-forming system, and transmitting the second plurality of signals to at least the first object and the second object at the second beam-forming system. The first input signal is associated with the first object, and the second input signal is associated with the second object.

According to yet another embodiment of the present invention, a system for detecting a plurality of objects includes a first divider system configured to receive a first input signal and generate a first divided signal and a second divided signal based on at least information associated with the first input signal, and a second divider system configured to receive a second input signal and generate a third divided signal and a fourth divided signal based on at least information associated with the second input signal. Additionally, the system includes a first phase shifter, a second phase shifter, a third phase shifter and a fourth phase shifter configured to process at least the first divided signal, the second divided signal, the third divided signal, and the fourth divided signal respectively. Moreover, the system includes a first combiner system configured to combining at least the first divided signal and the third divided signal into a first combined signal, and a second combiner system configured to combine at least the second divided signal and the fourth divided signal into a second combined signal. Also the system includes a first beam-forming system configured to generate a first plurality of signals based on at least information associated with the first combined signal, steer to a first direction associated with a first object, and transmit the first plurality of signals to at least the first object and a second object at the first beam-forming system. Additionally, the system includes a second beam-forming system configured to generate a second plurality of signals based on at least information associated with the second combined signal, steer to a second direction associated with the second object, and transmit the second plurality of signals to at least the first object and the second object at the second beam-forming system. The first input signal is associated with the first object, and the second input signal is associated with the second object.

Many benefits may be achieved by way of the present invention over conventional techniques. For example, certain embodiments of the present invention form a plurality of beams using one set of subarray outputs. The beam width of a subarray is usually broader in comparison to that of a beam formed using a plurality of subarrays. These embodiments of the present invention can steer several narrow beams within a region defined by the beam pattern of a subarray. Some embodiments of the present invention reduce hardware complexity. The reduction becomes increasingly pronounced with increasing number of subarrays and system level beams. For example, the reduction of the total number of components and cables in a phased array antenna system that produces 64 beams could be more than 80%. Certain embodiments of the present invention significantly reduce cost and power consumption of a phase array antenna system.

Depending upon the embodiment under consideration, one or more of these benefits may be achieved. These benefits and various additional objects, features and advantages of the present invention can be fully appreciated with reference to the detailed description and accompanying drawings that follow.

DETAILED DESCRIPTION OF THE INVENTION

The present invention relates in general to detecting objects and/or areas. More particularly, the invention provides a method and system for cluster beam-forming. Merely by way of example, the invention is described as it applies to a phased array antenna, but it should be recognized that the invention has a broader range of applicability.

Figure 1:
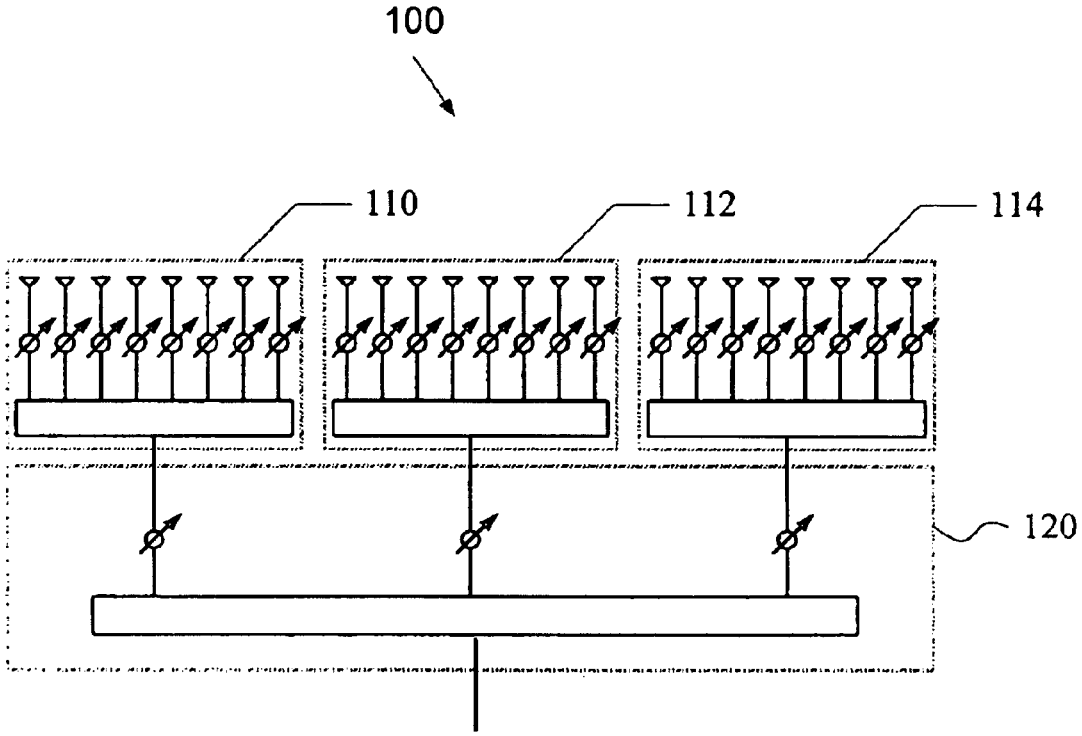
FIG. 1 is a simplified diagram for subarrays of antenna elements and an array of subarrays for an conventional phased array antenna.
Figure 2:
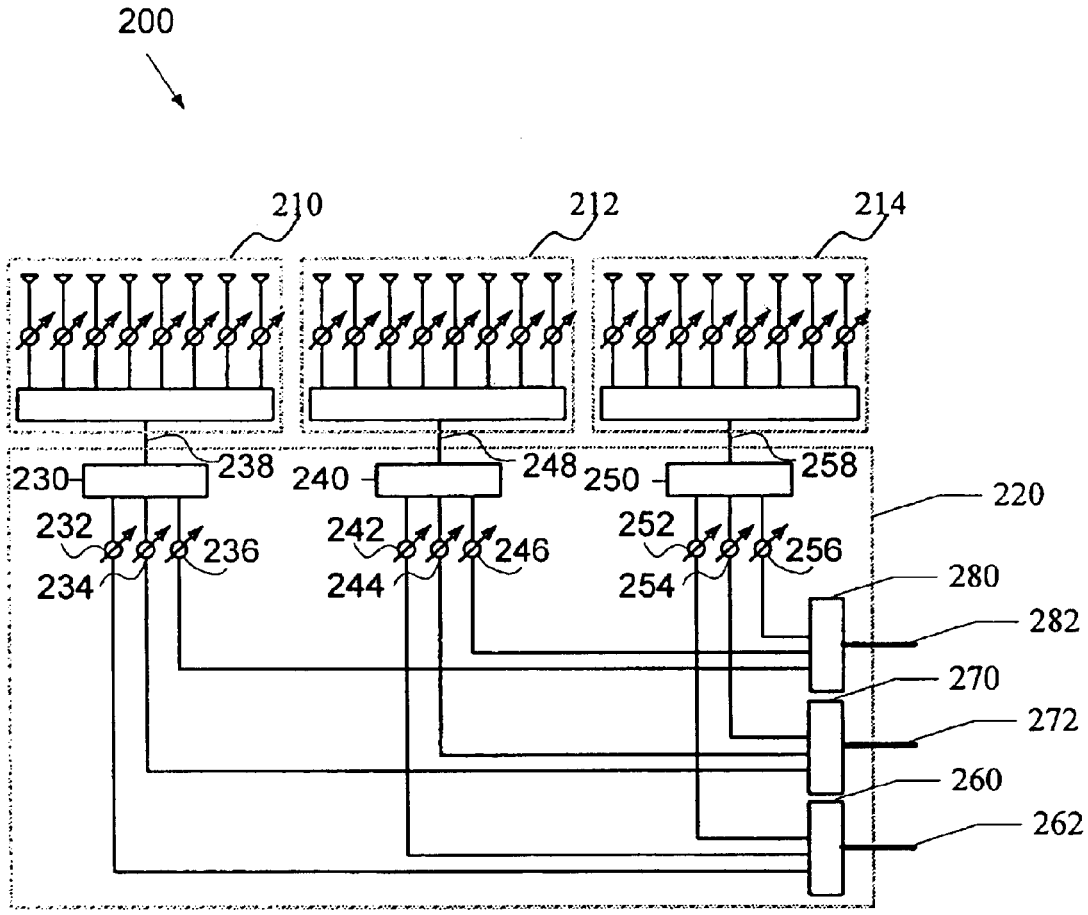
FIG. 2 is a simplified diagram for a cluster beam-forming system according to one embodiment of the present invention.

FIG. 2 is a simplified diagram for a cluster beam-forming system according to one embodiment of the present invention. This diagram is merely an example, which should not unduly limit the scope of the present invention. One of ordinary skill in the art would recognize many variations, alternatives, and modifications. A cluster beam-forming system 200 includes subarray beam-forming systems 210, 212, and 214, and a panel beam forming system 220. Although the above has been shown using systems 210, 212, 214, and 220, there can be many alternatives, modifications, and variations. For example, some of the systems may be expanded and/or combined. Additional subarray beam forming systems may be added to the cluster beam-forming system 200. Other systems may be inserted to those noted above. Depending upon the embodiment, the specific systems may be replaced. Further details of these systems are found throughout the present specification and more particularly below. The cluster beam-forming system 200 may be used to transmit signals, receive signals, or transmit and receive signals.

Figure 3:
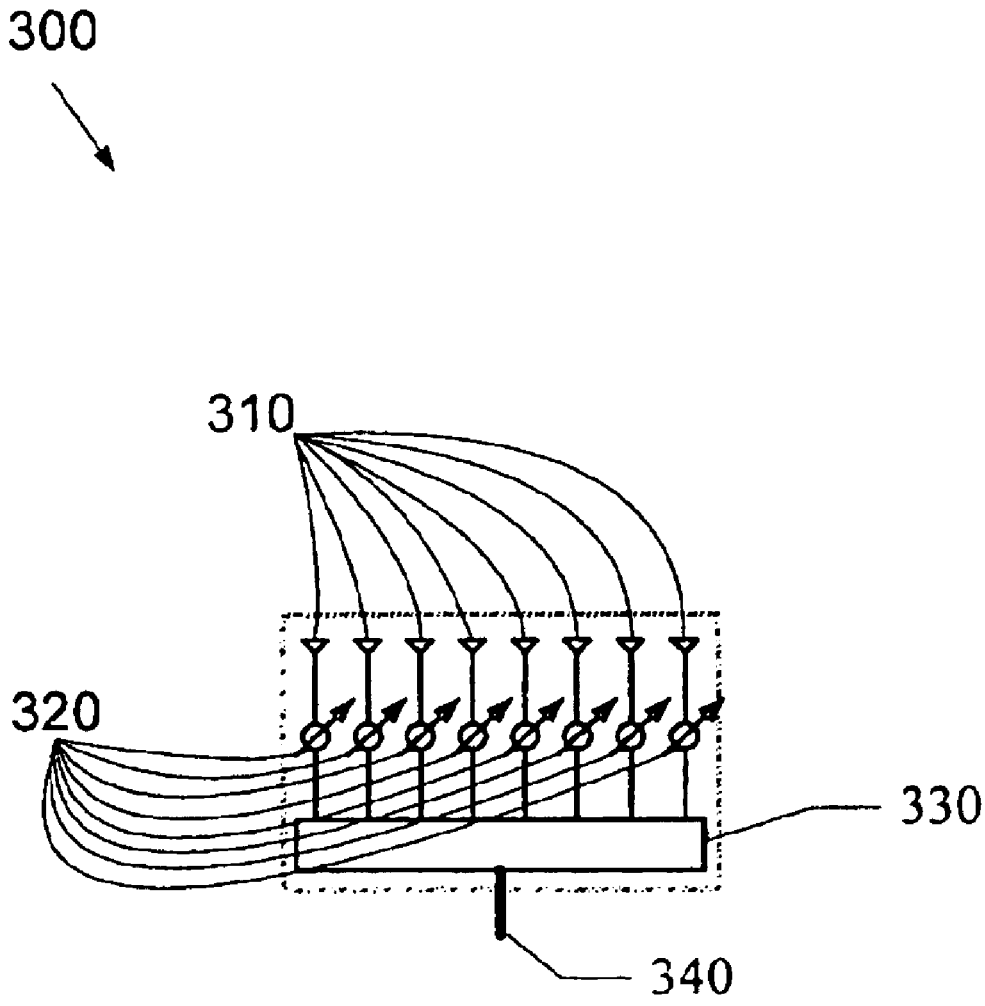
FIG. 3 is a simplified diagram for a subarray beam forming system in the cluster beam-forming system according to an embodiment of the present invention.

FIG. 3 is a simplified diagram for a subarray beam forming system in the cluster beam-forming system according to an embodiment of the present invention. This diagram is merely an example, which should not unduly limit the scope of the present invention. One of ordinary skill in the art would recognize many variations, alternatives, and modifications. An subarray beam forming system 300 includes antenna elements 310, phase shifters 320, and a signal combiner and divider system 330. Each of the phase shifter 320 can provide a phase change ranging from −180° to 180°. The signal combiner and divider system 330 generates or receives a subarray output or input 340. The subarray beam forming system 300 may also include low-noise amplifiers and a command and control system. The subarray beam forming system 300 can be the subarray beam forming system 210, 212, or 214. The subarray output or input 340 is applied to or received from the panel beam-forming system 220. The subarray beam forming system 300 can electronically steer the reception or transmission direction of the subarray without changing physical orientation of the subarray beam forming system. The subarray beam forming system 300 may be used to transmit signals, receive signals, or transmit and receive signals.

The panel beam-forming system 220 includes signal combiner and divider systems 230, 240, and 250, as shown in FIG. 2. Each of the signal combiner and divider systems 230, 240, and 250 divides one of the outputs 238, 248, and 258 into three signals or combines three signals into one of the outputs 238, 248, and 258. The outputs 238, 248, and 258 are generated or received by the subarray beam forming system 210, 212, and 214 respectively. The three signals from or to the signal combiner and divider system 230 are received or output by phase shifters 232, 234, and 236 respectively. Similarly, the three signals from or to the signal combiner and divider system 240 are received or output by phase shifters 242, 244, and 246 respectively. The three signals from or to the signal combiner and divider system 250 are received or output by phase shifters 252, 254, and 256 respectively. The phase shifters 232, 242, and 252 send or receive signals to or from a signal combiner and divider system 260 respectively; the phase shifters 234, 244, and 254 send or receive signals to or from a signal combiner and divider system 270; and the phase shifters 236, 246, and 256 send or receive signals to or from a signal combiner and divider system 280. The signal combiner and divider systems 260, 270, and 280 generate or receive beams 262, 272, and 282 respectively. These beams are the electronically scanned beams.

As discussed above and further emphasized here, FIG. 2 is merely an example, which should not unduly limit the scope of the present invention. One of ordinary skill in the art would recognize many variations, alternatives, and modifications. For example, the signal combiner and divider systems 230, 240, or 250 can divide one signal into a number of signals other than three, or combine a number of signals other than three into one signal. Accordingly, additional signal combiner and divider systems may be added to generate or receive beams in addition to the beams 262, 272, and 282, or some of the signal combiner and divider systems 230, 240, and 250 may be removed. In FIG. 2, the cluster beam forming system uses an one-dimensional array of antenna elements, but the cluster beam forming system can also use two-dimensional array of antenna elements. As another example, the cluster beam forming system may include a subarray beam forming system capable of forming multiple beams.

Figure 4:
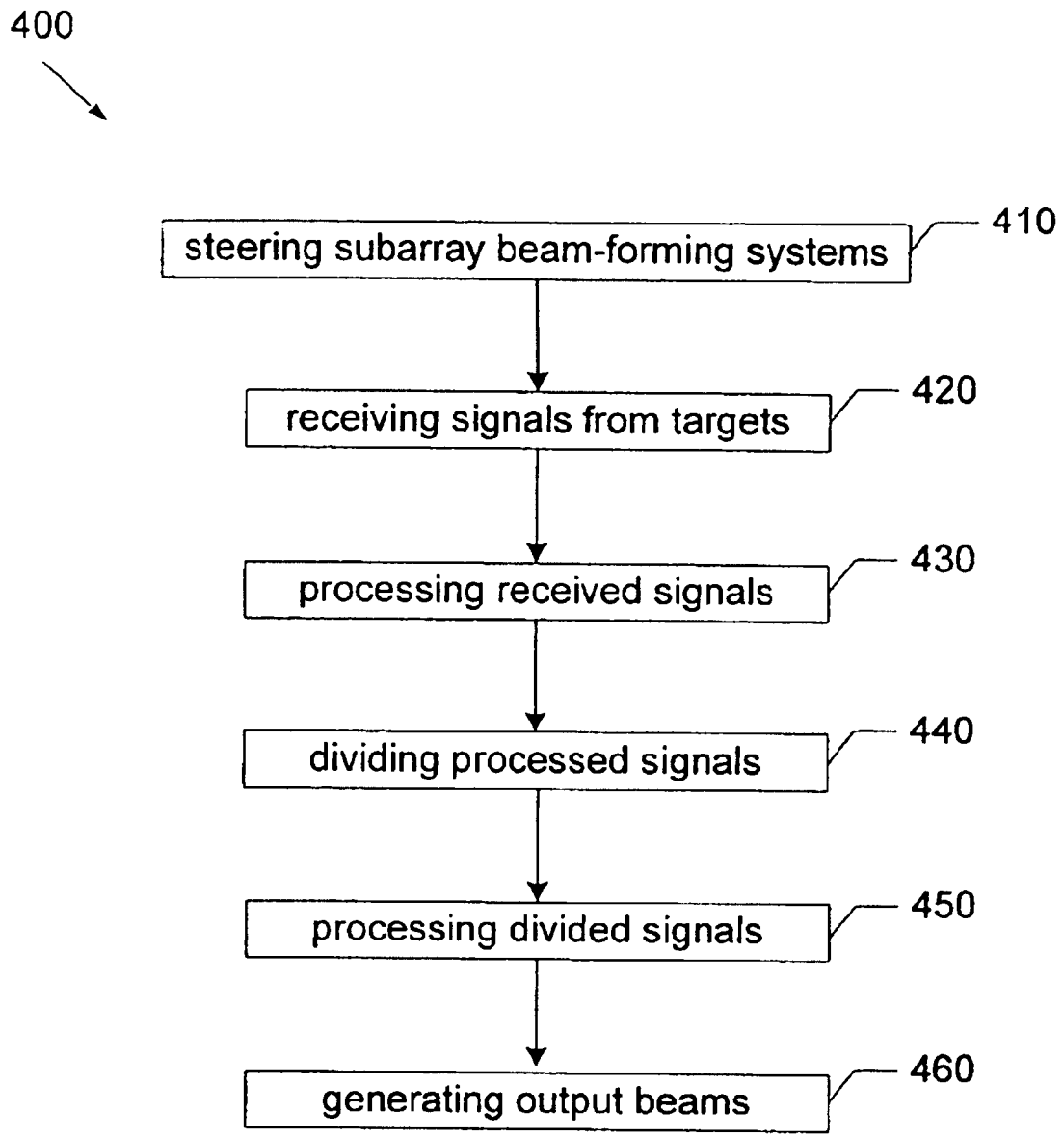
FIG. 4 is a simplified block diagram for a cluster beam-forming method according to one embodiment of the present invention.

FIG. 4 is a simplified block diagram for a cluster beam-forming method according to one embodiment of the present invention. This diagram is merely an example, which should not unduly limit the scope of the claims. One of ordinary skill in the art would recognize many variations, alternatives, and modifications. A cluster beam-forming method 400 includes a process 410 for steering subarray beam-forming systems, a process 420 for receiving signals from targets, a process 430 for processing received signals, a process 440 for dividing processed signals, a process 450 for processing divided signals, and a process 460 for generating output beams. Although the above has been shown using a selected sequence of processes, there can be many alternatives, modifications, and variations. For example, some of the processes may be expanded and/or combined. Other processes may be inserted to those noted above. Depending upon the embodiment, the specific sequence of steps may be interchanged with others replaced. Further details of these elements are found throughout the present specification and more particularly below.

At the process 410, the subarray beam-forming systems 210, 212, and 214 are each electronically steered to their respective directions. Each of these directions can be described by an azimuth angle and an elevation angle. For example, the azimuth angle is the horizontal angular separation measured clockwise from the north. For example, East has an azimuth angle of 90 degrees. The elevation angle is the angle in degrees above the horizon. For example, 0 degree corresponds to a direction parallel to the horizon and 90 degrees corresponds to a direction straight up. The directions for the subarray beam-forming systems 210, 212, and 214 can be set independently of each other, and they may be different or the same. For example, the subarray bean-forming systems 210, 212, and 214 track targets A, B, and C respectively.

The direction of a subarray beam-forming system is determined in part by the phase states of the phase shifters 320. The phase states of the phase shifters 320 depend on a set of voltages. The relationship between the set of voltages and the direction is described in a beam-forming calibration table. The beam-forming calibration table is a matrix of numbers, where the first two elements of a row of numbers indicate the azimuth angle and the elevation angle of the beam that should be pointing, and the rest of the elements in that row specify the voltages required to determine the phase states of all the associated phase shifters to cause the beam to point properly. The method and system to implement the circuits to electronically scan the beam of a phased array antenna is well known.

At the process 420, the subarray beam-forming systems 210, 212, and 214 receive signals from various targets. For example, the subarray beam-forming systems 210, 212, and 214 each receive signals from the targets A, B, and C, even though they are each steered towards only one of the targets A, B, and C.

At the process 430, the received signals are processed by the subarray beam-forming systems 210, 212, and 214. The processing usually includes performing phase shifts on signals received by various antenna elements. For example, the subarray beam forming system 210 is steered to the target A and receives signals from the targets A, B, and C. The received signals from various antenna elements 310 are delayed with respect to each other by the phase shifters 320, and the phase shifts substantially maximize the sum of the signals received at various antenna elements with respect to target A, depending on the electronic steering of the same subarray beam-forming system.

At the process 440, the processed signals from the subarray beam-forming systems 210, 212, and 214 are each divided into several signals. For example, the processed signal from the system 210 is divided into three signals by the signal combiner and divider system 230, and these three signals are sent to the phase shifters 232, 234, and 236 respectively. Similarly, the processed signal from the system 212 is divided into three signals sent to the phase shifters 242, 244, and 246. The processed signal from the system 214 is divided into three signals sent to the phase shifters 252, 254, and 256.

At the process 450, the divided signals are processed by the panel beam-forming system 220. The processing usually includes performing phase shifts on signals received by various subarray beam forming systems. For example, the phase shifters 232, 242, and 252 change the relative phases between the signals sent to these phase shifters and these phase shifters provide the appropriate phase delays to maximize the sum of the signals received by the subarrays from, for example, target A. Similarly, the phase shifters 234, 244, and 254 change the relative phases between the signals sent to these phase shifters and these phase shifters provide the appropriate phase delays to maximize the sum of the signals received by the subarrays from, for example, target B. The phase shifters 236, 246, and 256 change the relative phases between the signals sent to these phase shifters and these phase shifters provide the appropriate phase delays to maximize the sum of the signals received by the subarrays from, for example, target C.

At the process 460, output beams are generated by the signal combiner and divider systems 260, 270, and 280. For example, the signal combiner and divider system 260 receives the processed signals from the phase shifters 232, 242, and 252, and generates the output beam 262. Similarly, the signal combiner and divider system 270 receives the processed signals from the phase shifters 234, 244, and 254, and generates the output beam 272. The signal combiner and divider system 280 receives the processed signals from the phase shifters 236, 246, and 256, and generates the output beam 282. The output beams 262, 272 and 282 can be independently scanned to any point within the subarray beam pattern. For example, the output beams 262, 272, and 282 corresponds to the targets A, B, and C respectively.

Figure 4A:
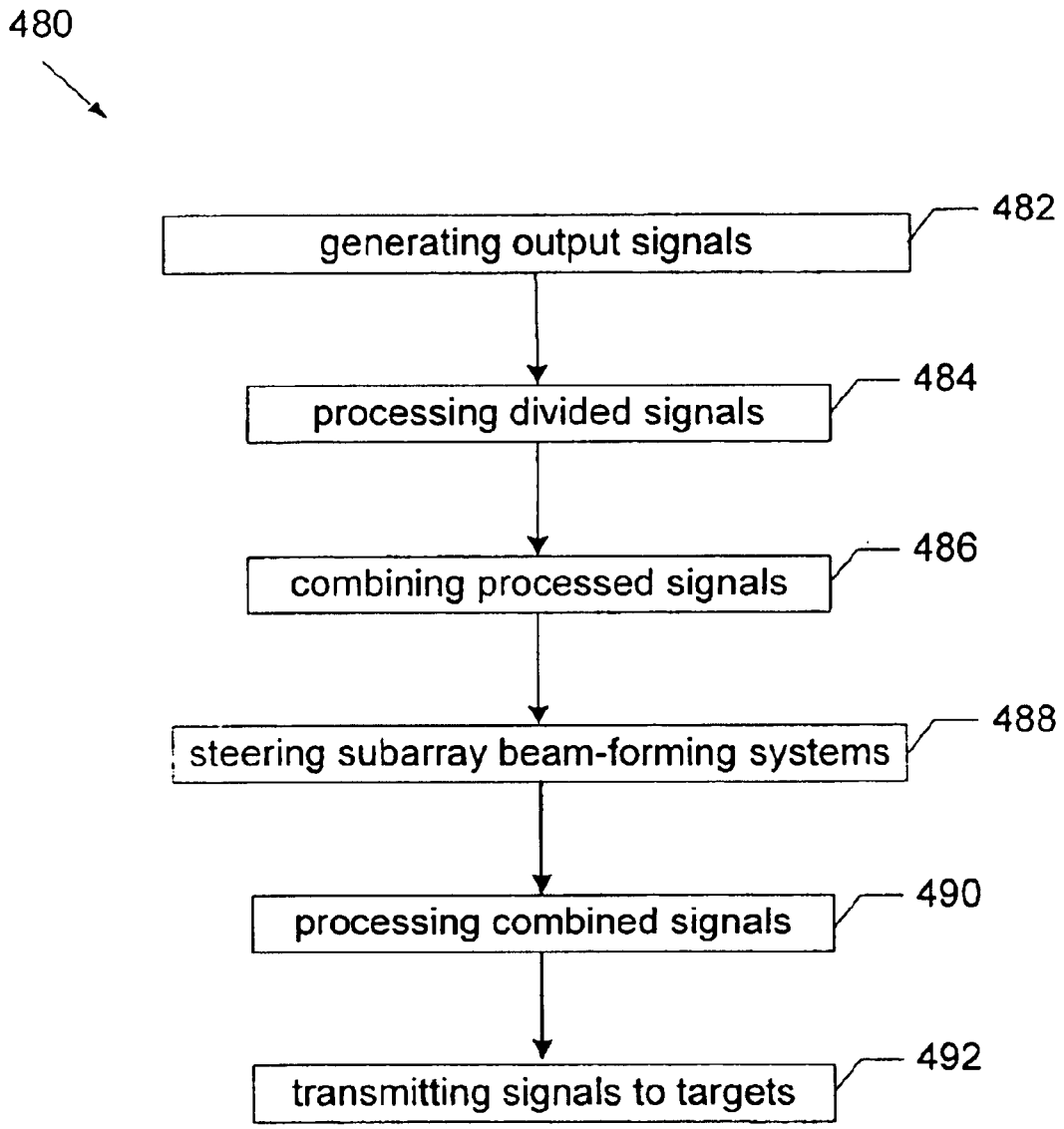
FIG. 4A is a simplified block diagram for a cluster beam-forming method according to another embodiment of the present invention.

FIG. 4A is a simplified block diagram for a cluster beam-forming method according to another embodiment of the present invention. This diagram is merely an example, which should not unduly limit the scope of the claims. One of ordinary skill in the art would recognize many variations, alternatives, and modifications. A cluster beam-forming method 480 includes a process 482 for generating output signals, a process 484 for processing divided signals, a process 486 for combining processed signals, a process 488 for steering subarray beam-forming systems, a process 490 for processing combined signals, and a process 492 for transmitting signals to targets. Although the above has been shown using a selected sequence of processes, there can be many alternatives, modifications, and variations. For example, some of the processes may be expanded and/or combined. Other processes may be inserted to those noted above. Depending upon the embodiment, the specific sequence of steps may be interchanged with others replaced. Further details of these elements are found throughout the present specification and more particularly below.

At the process 482, output signals are generated by the signal combiner and divider systems 260, 270, and 280. For example, the signal combiner and divider system 260 receives the beam 262 and generate three output signals to the phase shifters 232, 242, and 252 respectively. Similarly, the signal combiner and divider system 270 receives the beam 272 and generate three output signals to the phase shifters 234, 244, and 254 respectively. The signal combiner and divider system 280 receives the beam 282 and generate three output beams to the phase shifters 236, 246, and 256 respectively. The beams 262, 272 and 282 can be independently scanned to any point within the subarray beam pattern. For example, the beams 262, 272, and 282 corresponds to the targets A, B, and C respectively.

At the process 484, the output signals are processed by the panel beam-forming system 220. The processing usually includes performing phase shifts on signals received by various phase shifters. For example, the phase shifters 232, 242, and 252 change the relative phases between the output signals sent to these phase shifters and these phase shifters provide the appropriate phase delays to maximize the sum of the signals to be transmitted to, for example, target A. Similarly, the phase shifters 234, 244, and 254 change the relative phases between the output signals sent to these phase shifters and these phase shifters provide the appropriate phase delays to maximize the sum of the signals to be transmitted to, for example, target B. The phase shifters 236, 246, and 256 change the relative phases between the output signals sent to these phase shifters and these phase shifters provide the appropriate phase delays to maximize the sum of the signals to be transmitted to, for example, target C.

At the process 486, the processed signals from the phase shifters are combined. For example, the processed signals from the phase shifters 232, 234 and 236 are combined into one signal by the signal combiner and divider system 230, and this signal is sent to the system 210. Similarly, the processed signals from the phase shifters 242, 244, and 246 are combined into one signal to the system 212. The processed signals from the phase shifters 252, 254, and 256 are combined into one signal to the system 214.

At the process 488, the subarray beam-forming systems 210, 212, and 214 are each electronically steered to their respective directions. Each of these directions can be described by an azimuth angle and an elevation angle. The directions for the subarray beam-forming systems 210, 212, and 214 can be set independently of each other, and they may be different or the same. For example, the subarray beam-forming systems 210, 212, and 214 track targets A, B, and C respectively.

At the process 490, the combined signals are processed by the subarray beam-forming systems 210, 212, and 214. The processing usually includes performing phase shifts on signals received from the signal combiner and divider systems 230, 240 and 250. For example, the subarray beam forming system 210 is steered to the target A and transmits signals to the targets A, B, and C. The signals received from the signal combiner and divider system 230 are delayed with respect to each other by the phase shifters 320, and the phase shifts substantially maximize the sum of the signals transmitted at various antenna elements with respect to target A, depending on the electronic steering of the same subarray beam-forming system.

At the process 492, the subarray beam-forming systems 210, 212, and 214 transmit signals to various targets. For example, the subarray beam-forming systems 210, 212, and 214 each transmit signals to the targets A, B, and C, even though they are each steered towards only one of the targets A, B, and C.

As discussed above and further emphasized here, FIGS. 4 and 4A are merely examples, which should not unduly limit the scope of the claims. One of ordinary skill in the art would recognize many variations, alternatives, and modifications. The processes 410 and 490 for steering subarray beam-forming systems may each be a repetitive process. The subarray beam-forming systems 210, 212, and 214 each track the targets A, B, and C respectively. If the target A moves, the subarray beam-forming system 210 may need to steer to a different direction. According to an embodiment of the present invention, the steering process of a subarray beam-forming system does not change the location of the phase center for the subarray beam-forming system. For example, the beam of the subarray beam-forming system can be commanded to scan electronically in elevation and/or azimuth to following a target, while keep its phase response to another target stable.

The antenna phase center is the location of a point associated with an antenna such that, if it is taken as the center of a sphere whose radius extends to the far-field, the phase of a given field component over the surface of the radiation sphere is essentially constant at least over that portion of the surface where the radiation is significant. The antenna phase center may be located physically on the antenna itself or elsewhere. For example the phase center of a dish antenna could be located at a point in space that is in front of the dish. The constant phase over the surface of the radiation usually requires the variation in electrical phase falls within ±5°. The portion of the surface where the radiation is significant usually refers to the portion corresponding to the main beam of the antenna, say, within the 3 dB beamwidth of the antenna.

The determination of the phase center of a mechanically scanned antenna is well known. Simply, the antenna is scanned mechanically centered about a point, and if that point was the phase center of antenna, then the electrical phase at the output of the antenna would not change. Based on this method the location of the phase center can be verified or estimated. It is often the case that the location of the phase center is a function of frequency. The process of determining the phase center adds to the antenna cost, if the location of the phase center is not well known before hand or well controlled, and search has to be made over a large volume of uncertainty.

Figure 5:
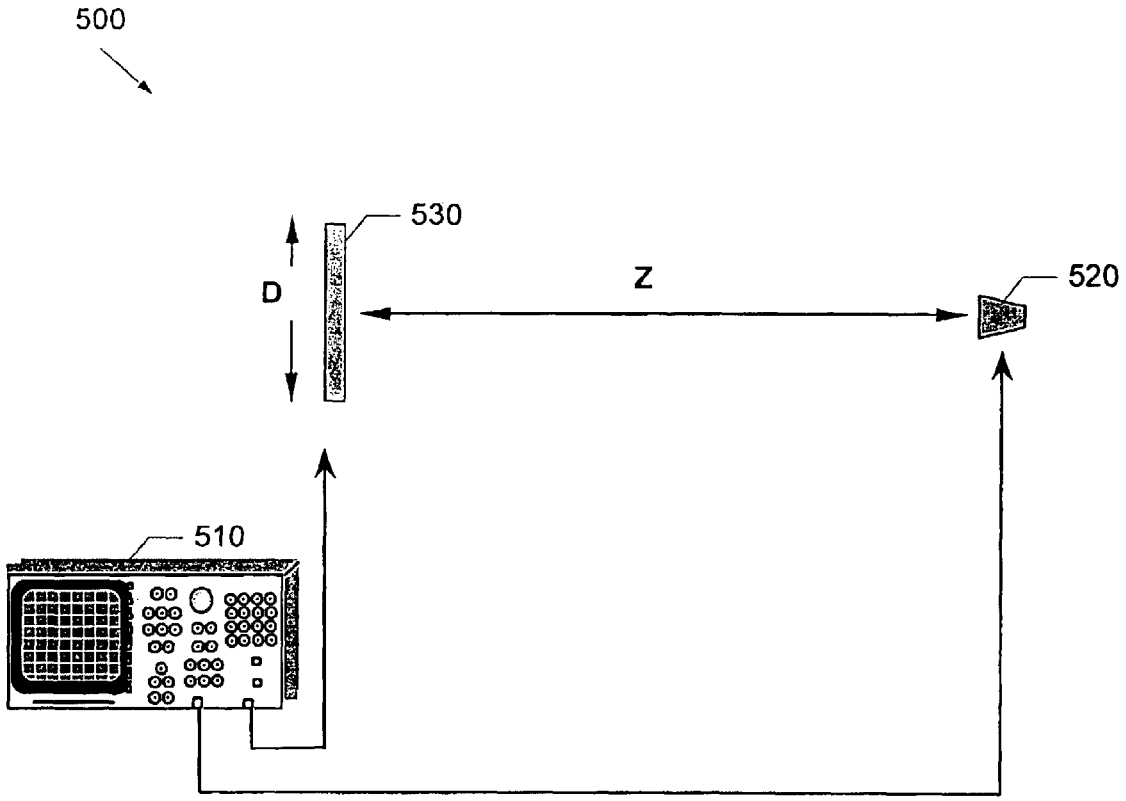
FIG. 5 is a simplified diagram for a phase center verification system according to one embodiment of the present invention.

FIG. 5 is a simplified diagram for a phase center verification system according to one embodiment of the present invention. This diagram is merely an example, which should not unduly limit the scope of the present invention. One of ordinary skill in the art would recognize many variations, alternatives, and modifications. A phase center verification system 500 includes a network analyzer 510, a transmit antenna 520, and an antenna under test 530. Although the above has been shown using systems 510, 520, and 530, there can be many alternatives, modifications, and variations. For example, some of the systems may be expanded and/or combined. Other systems may be inserted to those noted above. Depending upon the embodiment, the specific systems may be replaced. Further details of these systems are found throughout the present specification and more particularly below.

The network analyzer 510 generates a test signal, which is applied to the transmit antenna 520. The test signal traverses a distance Z and reaches the antenna under test 530. The distance Z should be greater than twice the Fresnel length, where the Fresnel length equals $$\frac{D^2}{\lambda}.$$

D is the longer dimension associated with the antenna under test 530, and λ is the wavelength of the test signal.

The antenna under test 520 is a phased array antenna or a subarray beam-forming system with an electronically scanned beam. The phased array antenna is commanded to scan its beam electronically over a sequence of pointing direction. The pointing direction is usually described by an azimuth angle and an elevation angle. At each pointing direction, the phased array antenna 530 receives a signal from the transmit antenna 520. For example, the signal from the transmit antenna 520 is a test signal generated by the network analyzer 510. The phase of the output signal of the antenna 530 is measured by the network analyzer 510 with respect to the test signal that the network analyzer 510 generates and for each pointing direction. The network analyzer may also process at least information associated with the measured phase and determine whether the phase center remains constant during the scanning process. If the measured phase over a certain range of pointing direction remains essentially constant, then the scanning process keeps constant the phase center of the antenna 530. The range of pointing directions usually corresponds to the beamwidth of the antenna 530 where the radiation is significant. If the measured phase does not stay constant over a certain range of pointing direction, then the phase center changes during scanning. Consequently, the beam-forming calibration table should be modified until the phase center remains substantially unchanged, such as within ±5°, as a function of beam scanning.

Figure 6:
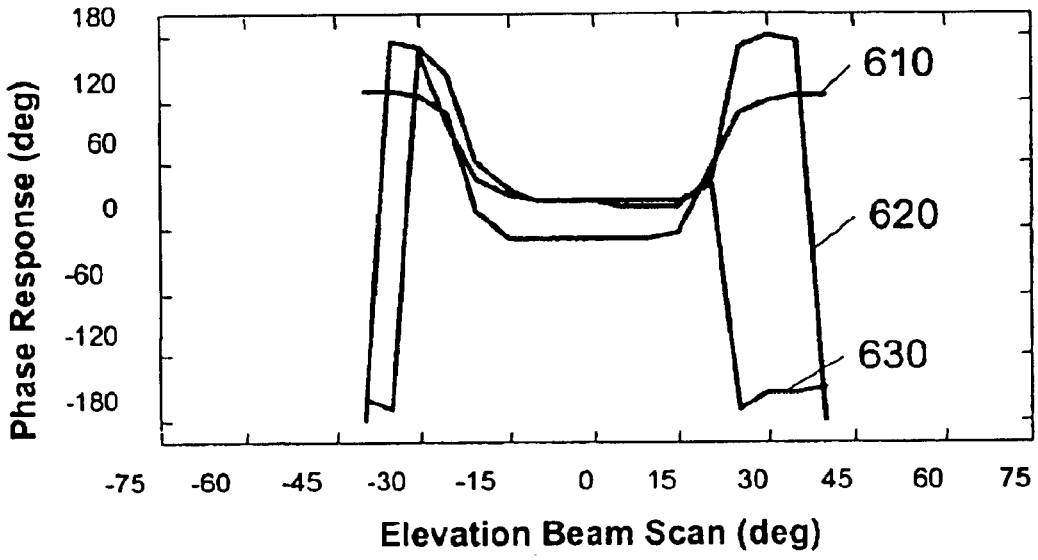
FIG. 6 is a simplified diagram for measured phase as a function of scan angle according to one embodiment of the present invention.

FIG. 6 is a simplified diagram for measured phase as a function of scan angle according to one embodiment of the present invention. This diagram is merely an example, which should not unduly limit the scope of the present invention. One of ordinary skill in the art would recognize many variations, alternatives, and modifications. The vertical axis is the measured phase of the output signal of the antenna 530, and the horizontal axis is the elevation scan angel. The plotted curves 610, 620, and 630 illustrate the phase response at the output of the antenna 530 as a function of the antenna beam being scanned electronically in elevation. The curves 610, 620, and 630 correspond to different frequencies of the test signal, and these frequencies equal to 2.22, 2.30 and 2.38 GHz respectively. During measurement, the antenna 530 is not physically moved, but the electronics in the antenna 530 are commanded to change their electronic states. The data show that when the beam is scanned by up to ±15° in elevation, the output phase of the antenna 530 is essentially constant. This verifies that the phase center of the antenna is stable when the beam is scanned.

Figure 7:
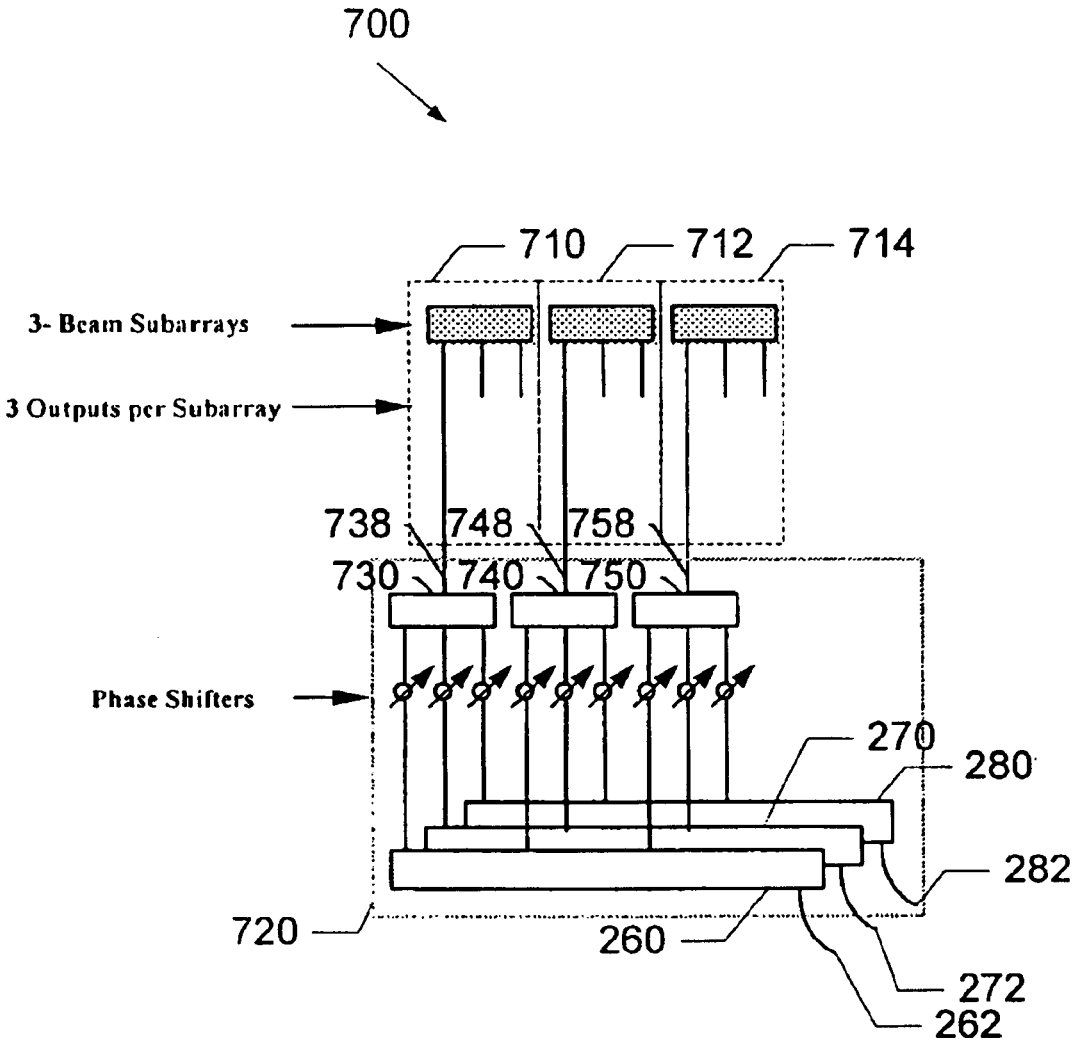
FIG. 7 is a simplified diagram for a cluster beam-forming system according to another embodiment of the present invention.

FIG. 7 is a simplified diagram for a cluster beam-forming system according to another embodiment of the present invention. This diagram is merely an example, which should not unduly limit the scope of the present invention. One of ordinary skill in the art would recognize many variations, alternatives, and modifications. A cluster beam-forming system 700 includes at least subarray beam-forming systems 710, 712, and 714, and a panel beam forming system 720. Although the above has been shown using systems 710, 712, 714, and 720, there can be many alternatives, modifications, and variations. For example, some of the systems may be expanded and/or combined. Additional two panel beam forming systems may be added to process signals received by the subarray beam-forming systems; and the cluster beam-forming system 700 generates or receives 9 beams corresponding to 9 targets. In another example, additional subarray beam forming systems may be added to the cluster beam-forming system 700. The cluster beam forming system 700 may be used to transmit signals, receive signals, or transmit and receive signals. Other systems may be inserted to those noted above. Depending upon the embodiment, the specific systems may be replaced. Further details of these systems are found throughout the present specification and more particularly below.

The subarray beam-forming systems 710, 712, and 714 each include a subarray beam-forming system substantially similar to the system 210. The systems 710, 712, and 714 each divide one signal into three outputs or combine three outputs into one signal. The subarray beam-forming systems 710, 712, and 714 each point to three directions. For example, the subarray beam-forming system 710 tracks targets A, B, and C. The subarray beam-forming system 712 tracks targets D, E, and F. The subarray beam-forming system 714 tracks targets G, H, and I. The panel beam-forming system 720 is substantially similar to the panel beam-forming system 220. For example, the panel beam-forming system 720 includes signal combiner and divider systems 730, 740, and 750. Each of the signal combiner and divider systems 730, 740, and 750 divides one of the outputs 738, 748, and 758 into three signals or combines three signals into one of the outputs 738, 748 and 758. The signal combiner and divider systems 260, 270, and 280 generate or receive beams 262, 272, and 282 respectively. For example, these beams electronically tracks the targets A, D, and G.

The cluster beam-forming method according to another embodiment of the present invention is substantially similar to the cluster beam-forming method 400. For example, the process for steering subarray beam-forming systems includes pointing each of the subarray beam-forming systems 710, 712, and 714 electronically to their respective three directions. The three directions for any subarray beam-forming systems 710, 712, and 714 can be set independently of each other, and they may be different or the same. For example, the subarray beam-forming system 710, 712, and 714 each track three different targets.

The cluster beam-forming method according to another embodiment of the present invention is substantially similar to the cluster beam-forming method 480. For example, the process for steering subarray beam-forming systems includes pointing each of the subarray beam-forming systems 710, 712, and 714 electronically to their respective three directions. The three directions for any subarray beam-forming systems 710, 712, and 714 can be set independently of each other, and they may be different or the same. For example, the subarray beam-forming system 710, 712, and 714 each track three different targets.

As discussed above and further emphasized here, FIG. 7 is merely an example, which should not unduly limit the scope of the present invention. One of ordinary skill in the art would recognize many variations, alternatives, and modifications. For example, the subarray beam-forming systems 710, 712, or 714 can point to a number of directions other than three. The number of directions associated with different subarray beam-forming systems may be different. The number of beams output from or received by the phased array is equal to the number of outputs or inputs of the panel beam-forming system 720.

The present invention has various applications. For example, the cluster beam-forming system according to one embodiment serves as a component of a multi-beam phased array antenna system. As another example, the cluster beam-forming system enables a spacecraft to track multiple aircrafts.

Figure 8:
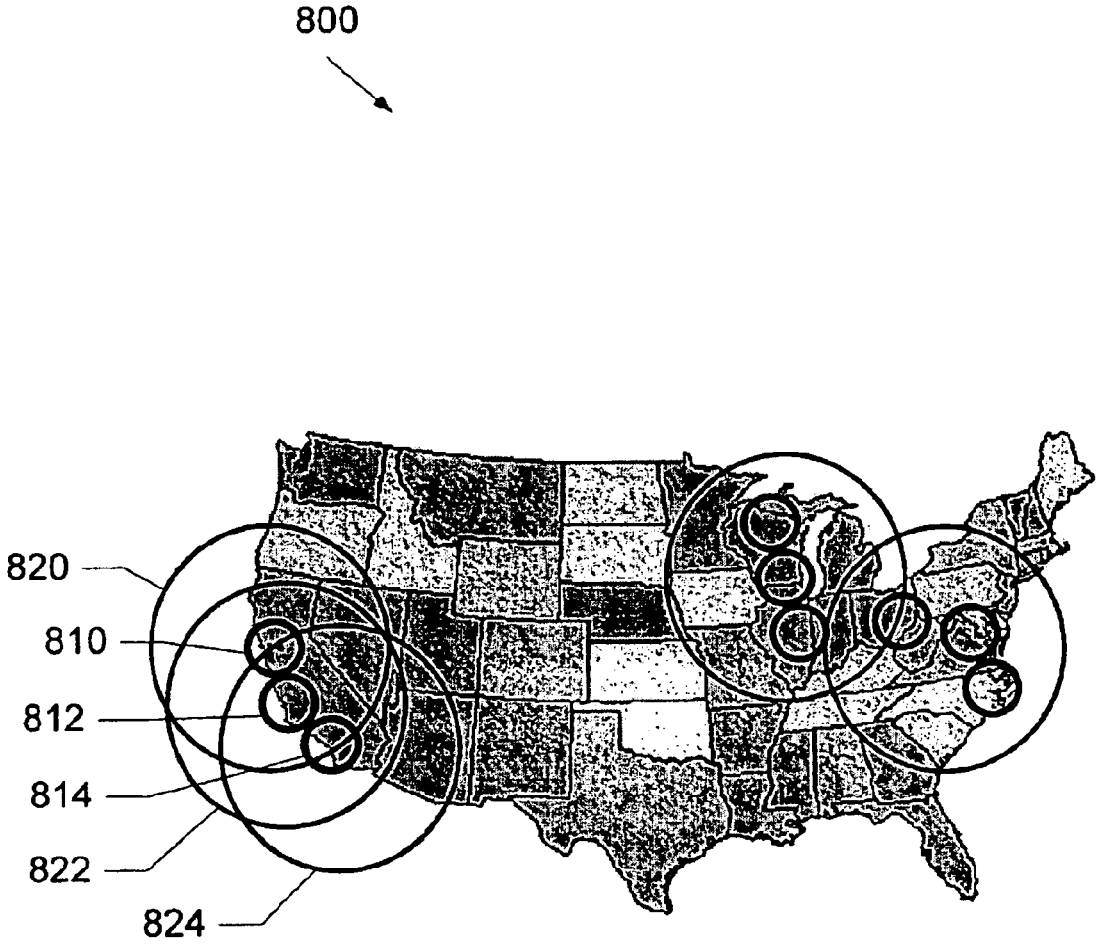
FIG. 8 is a simplified diagram for tracking multiple aircrafts according to one embodiment of the present invention.

FIG. 8 is a simplified diagram for tracking multiple aircrafts according to one embodiment of the present invention. This diagram is merely an example, which should not unduly limit the scope of the present invention. One of ordinary skill in the art would recognize many variations, alternatives, and modifications. As shown in FIG. 8, three aircrafts 810, 812, and 814 are monitored by a spacecraft. The spacecraft carries a cluster beam-forming system 200. The cluster beam-forming system 200 includes three subarray beam-forming systems 210, 212, and 214. The subarray beam-forming system 210 is set to track the aircraft 810, and receives signals from an area 820. Similarly, the subarray beam-forming system 212 is set to track the aircraft 812, and receives signals from an area 822. The subarray beam-forming system 214 is set to track the aircraft 814, and receives signals from an area 824. Each of the areas 820, 822, and 824 covers two or all of the three aircrafts 810, 812, and 814. With respect to the aircraft 812, the cluster beam-forming system 200 uses signals received not only by the subarray beam-forming system 212 but also by the subarray beam-forming systems 210 and 214. The cluster beam-forming system 200 performs phase shifts onto these signals and combine them to generate an output beam corresponding to the aircraft 812 as shown in FIG. 2. With respect to the aircraft 810, the cluster beam-forming system 200 uses signals received not only by the subarray beam-forming system 210 but also by the subarray beam-forming system 212. The cluster beam-forming system 200 performs phase shifts onto these signals and combine them to generate an output beam corresponding to the aircraft 810 as shown in FIG. 2. Similarly, the cluster beam-forming system 200 generates an output beam corresponding to the aircraft 814.

As discussed above and further emphasized here, FIG. 8 is merely an example, which should not unduly limit the scope of the present invention. One of ordinary skill in the art would recognize many variations, alternatives, and modifications. The cluster beam-forming system 700 may also be used to track the aircrafts 810, 812, and 814. As shown in FIG. 7, the cluster beam-forming system 700 can point to up to 9 directions; hence several directions may point to the same aircraft for redundancy.

Figure 9:
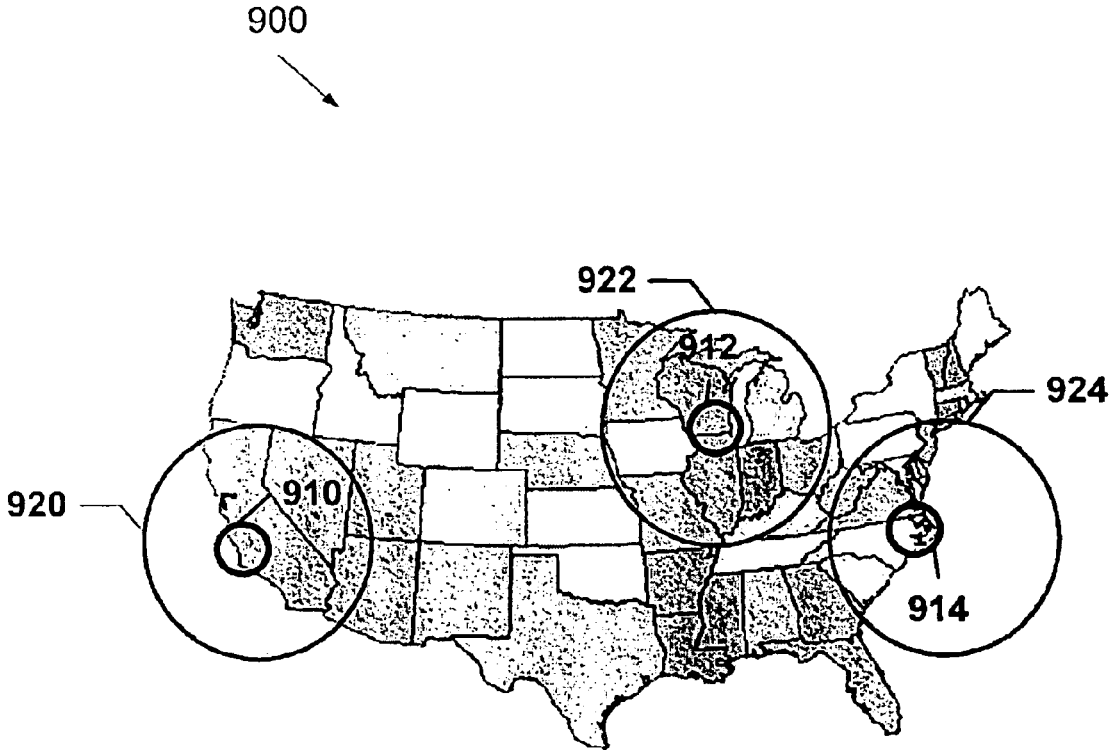
FIG. 9 is a simplified diagram for tracking multiple aircrafts according to another embodiment of the present invention.

FIG. 9 is a simplified diagram for tracking multiple aircrafts according to another embodiment of the present invention. This diagram is merely an example, which should not unduly limit the scope of the present invention. One of ordinary skill in the art would recognize many variations, alternatives, and modifications. As shown in FIG. 9, three aircrafts 910, 912, and 914 are monitored by a spacecraft. The spacecraft carries a cluster beam-forming system 200. The cluster beam-forming system 200 includes three subarray beam-forming systems 210, 212, and 214. The subarray beam-forming system 210 is set to track the aircraft 910, and receives signals from an area 920. Similarly, the subarray beam-forming system 212 is set to track the aircraft 912, and receives signals from an area 922. The subarray beam-forming system 214 is set to track the aircraft 914, and receives signals from an area 924. The area 920 covers the aircraft 910, not the aircrafts 912 and 914. Similarly, the area 922 covers the aircraft 912, not the aircrafts 910 and 914. The area 924 covers the aircraft 914, not the aircrafts 910 and 912. With respect to the aircraft 910, the cluster beam-forming system 200 uses only signals received by the subarray beam-forming system 210. This is implemented by adding a variable attenuator in serial with each phase shifter within the beam forming system 220. For example, the beam 262 is designated to track aircraft 910. When the output of subarray 210 provides the highest received signal level among all the subarrays from aircraft 910, then the attenuation of the attenuator in series with phase shifter 232 is set to a minimum attenuation. When the output of subarray 212 provides a received signal level of aircraft 910 that is a number of dB such as 1 dB below the highest received signal level from aircraft 910, then the attenuation of the variable attenuator in series with phase shifter 242 is set to a minimum attenuation plus a number of dB of additional attenuation such as 1 dB. When the subarray 214 provides a received signal level of aircraft 910 that is a number of dB such as 2 dB below the highest received signal from aircraft 910, then the attenuation of the variable attenuator in series with phase shifter 242 is set to a minimum attenuation plus a number of dB of additional attenuation such as 2 dB. Similar approaches are taken for the aircrafts 912 and 914.

As discussed above and further emphasized here, FIG. 9 is merely an example, which should not unduly limit the scope of the present invention. One of ordinary skill in the art would recognize many variations, alternatives, and modifications. The cluster beam-forming system 700 may also be used to track the aircrafts 910, 912, and 914. As shown in FIG. 7, the cluster beam-forming system 700 can point to up to 9 directions; hence several directions may point to the same aircraft for redundancy.

The present invention has various advantages. Certain embodiments of the present invention form a plurality of beams using one set of subarray outputs. The beam width of a subarray is usually broader in comparison to that of a beam formed using a plurality of subarrays. These embodiments of the present invention can steer several narrow beams within a region defined by the beam pattern of a subarray. Some embodiments of the present invention reduce hardware complexity. The reduction becomes increasingly pronounced with increasing number of subarrays and system level beams. For example, the reduction of the total number of components and cables in a phased array antenna system that produces 64 beams could be more than 80%. Certain embodiments of the present invention significantly reduce cost and power consumption of a phase array antenna system.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A method for detecting a plurality of objects, the method comprising:

steering a first beam-forming system to a first direction, the first direction associated with a first object;

steering a second beam-forming system to a second direction; the second direction associated with a second object;

receiving a first plurality of signals from at least the first object and the second object at the first beam-forming system;

receiving a second plurality of signals from at least the first object and the second object at the second beam-forming system;

processing the first plurality of received signals;

processing the second plurality of received signals;

generating a first combined signal based on at least information associated with the first plurality of received signals;

generating a second combined signal based on at least information associated with the second plurality of received signals;

dividing the first combined signal into at least a first divided signal and a second divided signal;

dividing the second combined signal into at least a third divided signal and a fourth divided signal;

processing at least the first divided signal, the second divided signal, the third divided signal, and the fourth divided signal;

generating a first output signal based on at least information associated the first divided signal and the third divided signal;

generating a second output signal based on at least information associated with the second divided signal and the fourth divided signal;

wherein the first output signal is associated with the first object;

the second output signal is associated with the second object.

2. The method of claim 1 wherein the steering a first beam-forming system is performed electronically, and the steering a second beam-forming system is performed electronically.

3. The method of claim 2 wherein the first direction is associated with a first azimuth angle and a first elevation angle, and the second direction is associated with a second azimuth angle and a second elevation angle.

4. The method of claim 2 wherein the steering a first beam-forming system to a first direction is substantially free from changing a first phase center of the first beam-forming system.

5. The method of claim 4 wherein the steering a second beam-forming system to a second direction is substantially free from changing a second phase center of the second beam-forming system.

6. The method of claim 5 wherein the receiving a first plurality of signals comprises receiving the first plurality of signals by a first plurality of antenna elements respectively, the first plurality of antenna elements associated with the first beam-forming system.

7. The method of claim 6 wherein the receiving a second plurality of signals comprises receiving the second plurality of signals by a second plurality of antenna elements respectively, the second plurality of antenna elements associated with the second beam-forming system.

8. The method of claim 7 wherein the processing the first plurality of received signals comprises performing a first plurality of phase shifts to the first plurality of received signals respectively.

9. The method of claim 8 wherein the processing the second plurality of received signals comprises performing a second plurality of phase shifts to the second plurality of received signals respectively.

10. The method of claim 9 wherein the processing at least the first divided signal, the second divided signal, the third divided signal, and the fourth divided signal comprises performing a first phase shift, a second phase shift, a third phase shift and a fourth phase shift to the first divided signal, the second divided signal, the third divided signal, and the fourth divided signal respectively.

11. The method of claim 10 wherein generating a first output signal comprises combining the first divided signal and the third divided signal, and generating a second output signal comprises combining the second divided signal and the fourth divided signal.

12. A method for detecting a plurality of objects, the method comprising:

steering a first beam-forming system to a first direction, the first direction associated with a first object;

steering a second beam-forming system to a second direction; the second direction associated with a second object;

receiving a first plurality of signals from at least the first object and the second object at the first beam-forming system;

receiving a second plurality of signals from at least the first object and the second object at the second beam-forming system;

generating a first combined signal based on at least information associated with the first plurality of received signals;

generating a second combined signal based on at least information associated with the second plurality of received signals;

dividing the first combined signal into at least a first divided signal and a second divided signal;

dividing the second combined signal into at least a third divided signal and a fourth divided signal;

generating a first output signal based on at least information associated with the first divided signal and the third divided signal;

generating a second output signal based on at least information associated with the second divided signal and the fourth divided signal;

wherein the steering a first beam-forming system to a first direction is substantially free from changing a first phase center of the first beam-forming system;

the steering a second beam-forming system to a second direction is substantially free from changing a second phase center of the second beam-forming system;

the first output signal is associated with the first object;

the second output signal is associated with the second object.

13. The method of claim 12 wherein the steering a first beam-forming system is performed electronically, and the steering a second beam-forming system is performed electronically.

14. A system for detecting a plurality of objects, the system comprising:

a first beam-forming system configured to steer to a first direction, the first direction associated with a first object;

receive a first plurality of signals from at least the first object and a second object;

generate a first combined signal based on at least information associated with the first plurality of received signals;

a second beam-forming system configured to steer to a second direction, the second direction associated with the second object;

receive a second plurality of signals from at least the first object and the second object;

generate a second combined signal based on at least information associated with the second plurality of received signals;

a first divider system configured to divide the first combined signal into at least a first divided signal and a second divided signal;

a second divider system configured to divide the second combined signal into at least a third divided signal and a fourth divided signal;

a first phase shifter, a second phase shifter, a third phase shifter and a fourth phase shifter configured to process at least the first divided signal, the second divided signal, the third divided signal, and the fourth divided signal respectively;

a first combiner system configured to generate a first output signal based on at least information associated the first divided signal and the third divided signal;

a second combiner system configured to generate a second output signal based on at least information associated with the second divided signal and the fourth divided signal;

wherein the first output signal is associated with the first object;

the second output signal is associated with the second object.

15. The system of claim 14 wherein the first beam-forming system steers electronically, and the second beam-forming system steers electronically.

16. The system of claim 15 wherein the first direction is associated with a first azimuth angle and a first elevation angle, and the second direction is associated with a second azimuth angle and a second elevation angle.

17. The system of claim 15 wherein the first beam-forming system steers electronically without substantially changing a first phase center of the first beam-forming system, and the second beam-forming system steers electronically without substantially changing a second phase center of the second beam-forming system.

18. The system of claim 17 wherein the first beam-forming system comprises a first plurality of antenna elements configured to receive the first plurality of signals respectively;

a first plurality of phase shifters configured to process the first plurality of received signals respectively.

19. The system of claim 18 wherein the first plurality of phase shifters are configured to provide a first plurality of phase changes to the first plurality of received signals respectively, each of the first plurality of phase changes ranging from −180° to 180°.

20. The system of claim 18 wherein generating a first output signal comprises combining the first divided signal and the third divided signal, and generating a second output signal comprises combining the second divided signal and the fourth divided signal.

21. A system for detecting a plurality of objects, the system comprising:

a first beam-forming system configured to steer to a first direction, the first direction associated with a first object;

receive a first plurality of signals from at least the first object and a second object;

generate a first combined signal based on at least information associated with the first plurality of received signals;

a second beam-forming system configured to steer to a second direction, the second direction associated with the second object;

receive a second plurality of signals from at least the first object and the second object;

generate a second combined signal based on at least information associated with the second plurality of received signal;

a first divider system configured to divide the first combined signal into at least a first divided signal and a second divided signal;

a second divider system configured to divide the second combined signal into at least a third divided signal and a fourth divided signal;

a first combiner system configured to generate a first output signal based on at least information associated the first divided signal and the third divided signal;

a second combiner system configured to generate a second output signal based on at least information associated with the second divided signal and the fourth divided signal;

wherein the first beam-forming system is configured to steer electronically without substantially changing a first phase center of the first beam-forming system;

the second beam-forming system is configured to steer electronically without substantially changing a second phase center of the second beam-forming system;

the first output signal is associated with the first object;

the second output signal is associated with the second object.

22. The system of claim 21 wherein the first beam-forming system steers electronically, and the second beam-forming system steers electronically.

23. A method for detecting a plurality of objects, the method comprising:

receiving a first input signal;

receiving a second input signal;

generating a first divided signal and a second divided signal based on at least information associated with the first input signal;

generating a third divided signal and a fourth divided signal based on at least information associated with the second input signal;

processing at least the first divided signal, the second divided signal, the third divided signal, and the fourth divided signal;

combining at least the first divided signal and the third divided signal into a first combined signal;

combining at least the second divided signal and the fourth divided signal into a second combined signal;

generating a first plurality of signals based on at least information associated with the first combined signal;

generating a second plurality of signals based on at least information associated with the second combined signal;

steering a first beam-forming system to a first direction, the first direction associated with a first object;

steering a second beam-forming system to a second direction; the second direction associated with a second object;

processing the first plurality of signals;

processing the second plurality of signals;

transmitting the first plurality of signals to at least the first object and the second object at the first beam-forming system;

transmitting the second plurality of signals to at least the first object and the second object at the second beam-forming system;

wherein the first input signal is associated with the first object;

the second input signal is associated with the second object.

24. A system for detecting a plurality of objects, the system comprising:

a first divider system configured to receive a first input signal and generate a first divided signal and a second divided signal based on at least information associated with the first input signal;

a second divider system configured to receive a second input signal and generate a third divided signal and a fourth divided signal based on at least information associated with the second input signal;

a first phase shifter, a second phase shifter, a third phase shifter and a fourth phase shifter configured to process at least the first divided signal, the second divided signal, the third divided signal, and the fourth divided signal respectively;

a first combiner system configured to combining at least the first divided signal and the third divided signal into a first combined signal;

a second combiner system configured to combine at least the second divided signal and the fourth divided signal into a second combined signal;

a first beam-forming system configured to:

generate a first plurality of signals based on at least information associated with the first combined signal;

steer to a first direction, the first direction associated with a first object;

transmit the first plurality of signals to at least the first object and a second object at the first beam-forming system;

a second beam-forming system configured to:

generate a second plurality of signals based on at least information associated with the second combined signal;

steer to a second direction; the second direction associated with the second object;

transmit the second plurality of signals to at least the first object and the second object at the second beam-forming system;

wherein the first input signal is associated with the first object;

the second input signal is associated with the second object.

* * * * *

UNITED STATES PATENT AND TRADEMARK OFFICE

CERTIFICATE OF CORRECTION

PATENT NO. : 6,906,665 B1
DATED : June 14, 2005
INVENTOR(S) : Lawrence K. Lam

It is certified that error appears in the above-identified patent and that said Letters Patent is hereby corrected as shown below:

Column 18,
Lines 66-67, "associated the" should read -- associated with the --.

Signed and Sealed this

Eleventh Day of October, 2005

JON W. DUDAS
*Director of the United States Patent and Trademark Office*